US007622016B2

(12) United States Patent
Lee

(10) Patent No.: US 7,622,016 B2
(45) Date of Patent: Nov. 24, 2009

(54) RETAINER RING OF CHEMICAL MECHANICAL POLISHING DEVICE

(75) Inventor: Han-Ju Lee, Bucheon-si (KR)

(73) Assignee: Will Be S & T Co., Ltd., Hwasung-Si, Gyeonggi-Do (KR)

( * ) Notice: Subject to any disclaimer, the term of this patent is extended or adjusted under 35 U.S.C. 154(b) by 337 days.

(21) Appl. No.: 11/454,154

(22) Filed: Jun. 16, 2006

(65) Prior Publication Data

US 2007/0034335 A1 Feb. 15, 2007

(30) Foreign Application Priority Data

Jun. 16, 2005 (KR) ..... 20-2005-0017397 U

(51) Int. Cl.
*H01L 21/302* (2006.01)

(52) U.S. Cl. ..... 156/345.14; 156/345.12

(58) Field of Classification Search ..... 156/345.12, 156/345.14

See application file for complete search history.

(56) References Cited

U.S. PATENT DOCUMENTS 6,277,008 B1 * 8/2001 Masuta et al. ..... 451/286
6,824,458 B2 * 11/2004 Ensinger ..... 451/415
6,974,371 B2 * 12/2005 Chen et al. ..... 451/398
2004/0259485 A1 * 12/2004 Ensinger ..... 451/287
2007/0034335 A1 * 2/2007 Lee ..... 156/345.12

FOREIGN PATENT DOCUMENTS

JP KR1020010055213 * 7/2001

OTHER PUBLICATIONS

Machine generated translation of KR1020010055213, 9 pages, Published Jul. 2001.*

* cited by examiner

*Primary Examiner*—Sylvia R. MacArthur
(74) *Attorney, Agent, or Firm*—Robert E. Bushnell, Esq.

(57) ABSTRACT

A retainer ring of a chemical-mechanical polishing device which can prevent itself from being twisted and improve defective proportion and equipment operating rate occurred when polishing semiconductor wafers by embedding a metal member inside.

Retainer ring installed to a polishing head of a chemical mechanical polishing device to fix a semiconductor wafer includes: a first member of a resin connected to a carrier of the polishing head and a room is formed inside; a second member of a metal embedded into the room of the first member.

The present invention can improve a defective proportion of a semiconductor wafer polishing process by above effects and can reduce initial limitation conditions accompanied to mass production to increase an equipment operation rate by providing credibility of the retaining ring.

10 Claims, 5 Drawing Sheets

RETAINER RING OF CHEMICAL MECHANICAL POLISHING DEVICE

CLAIM OF PRIORITY

This application makes reference to, incorporates the same herein, and claims all benefits accruing under 35 U.S.C.§ 119 from an application for RETAINER RING OF CHEMICAL MECHANICAL POLISHING APPARATUS earlier filed in the Korean Intellectual Property Office on 16 Jun. 2005 and there duly assigned Serial No. 20-2005-0017397.

BACKGROUND OF THE INVENTION

1. Technical Field

The present invention relates to a retainer ring which is installed to a polishing head of a chemical-mechanical polishing device for processing semiconductor wafers, and more particularly, to a retainer ring of a chemical-mechanical polishing device which can prevent itself from being twisted and improve defective proportion and equipment operating rate occurred when polishing semiconductor wafers by embedding a metal member inside.

2. Background Art

Recently, surface ununiformity of a semiconductor device has been increased in accordance with the tendencies of high density, fineness and variety of wiring structures of the semiconductor device.

Thus, various devices have been developed to increase the degree of flatness of the semiconductor device's surface. A chemical mechanical polishing device, which makes the surface of the semiconductor device flat by performing a chemical polishing work and a mechanical polishing work at the same time, is widely used.

Such a conventional chemical mechanical polishing device gets a semiconductor wafer 30 absorbed to the bottom of a polishing head retaining the semiconductor wafer 30, wraps the semiconductor wafer 30 with a retainer ring so that the semiconductor wafer 30 is not relieved of the bottom of the polishing head during polishing the semiconductor wafer 30, and polishes the semiconductor wafer 30 with a slurry provided between the semiconductor wafer 30 and the polishing pad while the semiconductor wafer 30, which is retained in the polishing head, is pressed toward the polishing pad at a predetermined pressure.

At this time, the semiconductor wafer 30 is polished by the slurry and the rotation movement of the polishing pad 20 chemically and mechanically at the same time.

FIG. 7 shows a sectional view illustrating a retainer ring of a conventional chemical mechanical polishing device.

The retainer ring 720 is comprised of a first member 722, which is contacted to the polishing pad 20, and a second member 724, which is connected to a carrier of the polishing head.

The first member 722 is made of resin material as like engineering plastic whereas the second member 724 is made of metal material as like stainless steel.

Further, the first member 722 and the second member 724 are bonded together firmly by bonding using adhesives.

Such the retainer ring 720 can prevent its deformity and damages of the polishing pad 20 because the degree of flatness of the bottom side of the first member, which is connected to the polishing pad 20, is maintained by the second member made of metal material.

However, such the conventional retainer ring of the chemical-mechanical polishing device has a problem that scratches of the semiconductor wafer can occur because particles can be generated by corrosion of the slurry due to the bonding.

Further, uniformity within the semiconductor wafer is not enough and, accordingly, reduction of product yield can be caused because space contacting pressure between the polishing pad 20 and the semiconductor wafer cannot to be maintained evenly around the circumference of the semiconductor wafer by deformation due to the twist effect of the retainer ring Still further, polishing speed at the selected area of the semiconductor wafer is not constant and, accordingly, defective proportion is relatively higher because the flow of the slurry is not smooth enough in the conventional retainer ring.

Technical Problem

An object of the present invention is to provide a retainer ring of a chemical Mechanical polishing device capable of preventing it self from being twisted even without using bonding connection, preventing particles from being generated in accordance with the corrosion of the slurry due to the bonding of an engineering plastic, smoothing the flow of the slurry of polishing material, and reducing production cost by embedding a metal member inside itself.

Another object of the present invention is to provide a retainer ring for a chemical mechanical polishing device capable of easing attaching and/or detaching and preventing from being loosened by making the retainer ring with a upper portion and a lower portion, and connecting them by a plurality of bolts made of resin material.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

<BRIEF DESCRIPTION OF THE PARTS>

10: polishing head 20: polishing pad

30: semiconductor wafer 110: carrier

120: retainer ring 122: first member

124: second member 130: vacuum duct
140: membrane

DETAILED DESCRIPTION OF THE INVENTION

According to an aspect of the present invention, a retainer ring installed to a polishing head of a chemical mechanical polishing device to fix a semiconductor wafer is provided. The retainer ring includes:

a first member made of resin and connected to a carrier of the polishing head and a room is formed inside;

a second member of a metal embedded into the room of the first member.

It is preferable that the second member is made of material such as stainless steel, steel, aluminum, brass, etc.

It is further preferable that the second member is comprised of two pieces which are connected by welding.

It is still further preferable that a tap for welding from one end of the first member that is connected to the carrier to the second member.

It is still further preferable that a through hole which penetrates the first member and the second member is provided.

It is still further preferable that a taper is provided with the through hole toward outside of the carrier.

It is still further preferable that a third member which is made of the same material as well as the first member but purer than the first member is welded at the bottom of the first member by melting with a friction heat.

It is still further preferable that the first member and the third member are made of material selected from a group consisting of Polyphenylene sulfide (PPS), Polyimide, Polybenzimidasole (PBI), Polyetheretheketon (PEEK), Polycarbonate, Acetal, Polyetherimid (PEI), Polybutylene terephthalate (PBT) and Polyethylene terephthalate (PET), etc, According to another aspect of the present invention, a retainer ring installed to a polishing head of a chemical mechanical polishing device to fix a semiconductor wafer is provided. The retainer ring includes:

a upper portion connected to a carrier of the polishing head; and a lower portion connected to the upper portion through a plurality of bolts, wherein the upper portion and the lower portion are made of a resin and rooms are formed thereto, respectively, and a second member of metal is embedded into the room of the first member.

It is preferable that the second member is made of material such as stainless steel, steel, aluminum, brass, etc.

It is preferable that the bolt is made of a resin.

It is preferable that a through hole, which penetrates one end of the bolt and a corresponding position of the bolt in a line, is provided, and a spring pin is inserted into the through hole.

It is preferable that a through hole is provided to penetrate the spring pin.

The retainer ring according to the present invention will now be described in detail taken with accompanied drawings.

Figure 1:
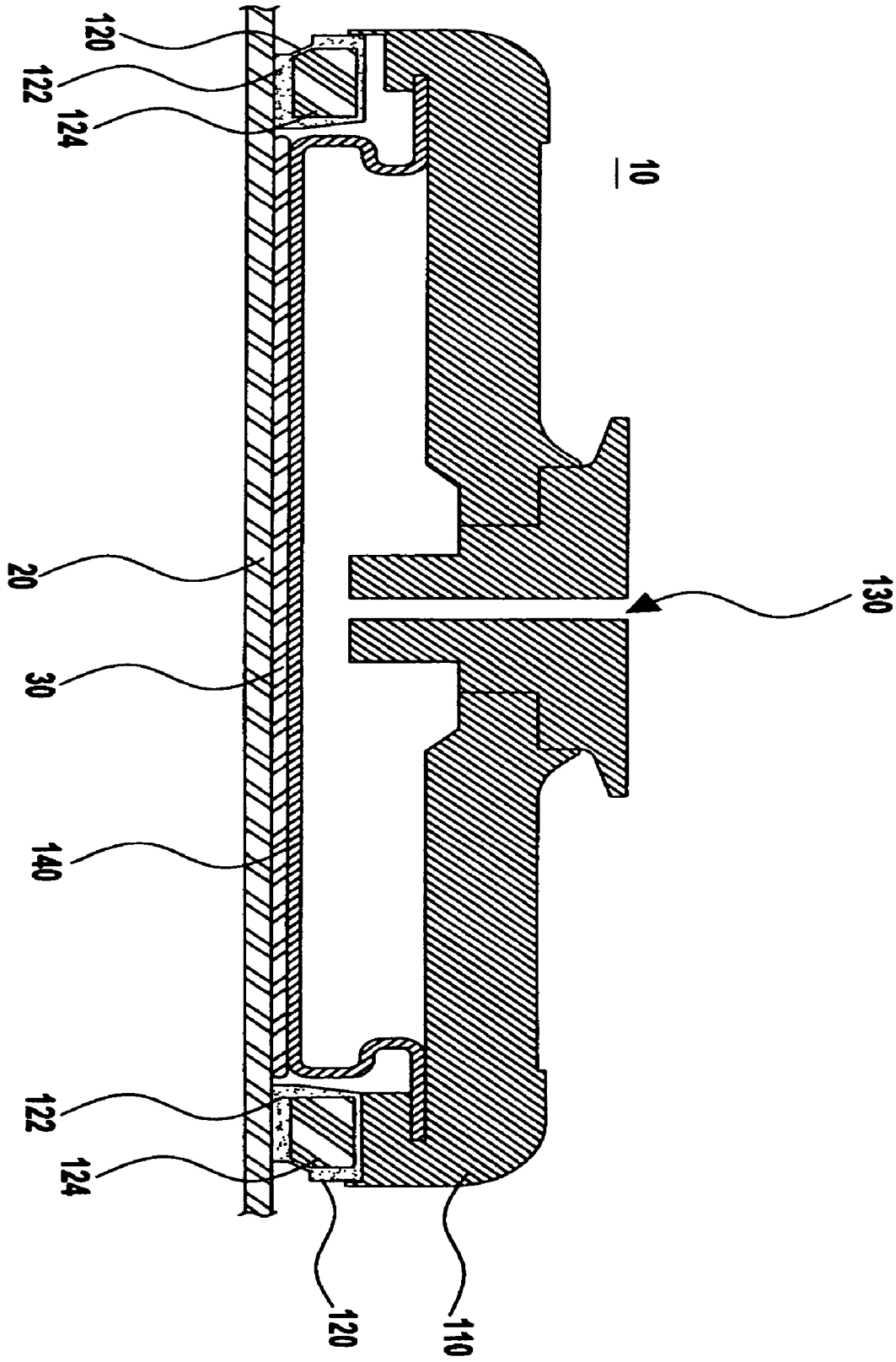
FIG. 1 shows a partial sectional view illustrating a polishing head of a chemical-mechanical polishing device to which a retainer ring according to the first embodiment of the present invention is installed.

FIG. 1 shows a partial sectional view illustrating a polishing head of a chemical-mechanical polishing device to which a retainer ring according to the first embodiment of the present invention is installed.

A polishing head 10 of the chemical mechanical polishing device retains a semiconductor wafer 30 by a way of vacuum absorbing, for example, and polishes the semiconductor wafer 30 by contacting it to a polishing pad 20.

The polishing head 10 is comprised of a carrier 110, a retainer ring 120 which is connected to the bottom of the carrier 110 to support the semiconductor wafer 30, a vacuum duct 130 through which vacuum pressure is delivered from outside and a membrane 140 which absorbs the semiconductor wafer 30 by the vacuum pressure.

Figure 2A:
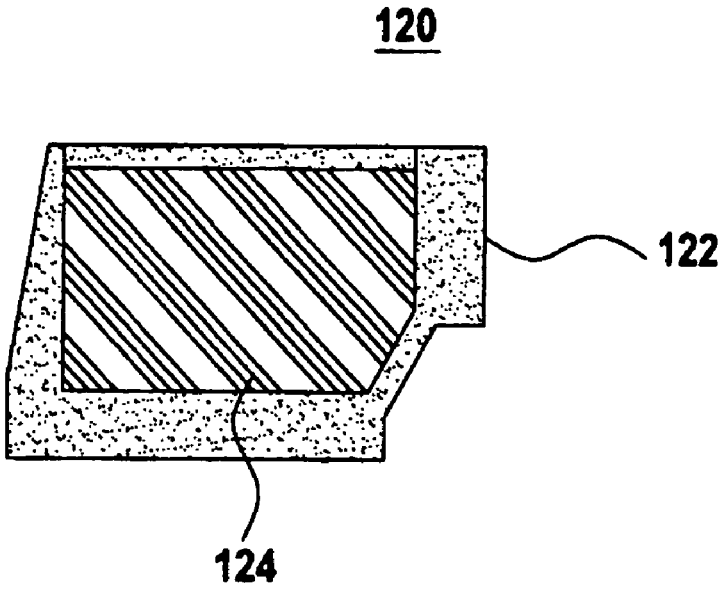
FIG. 2A shows an enlarged sectional view of the retainer ring shown in FIG. 1.
Figure 2B:
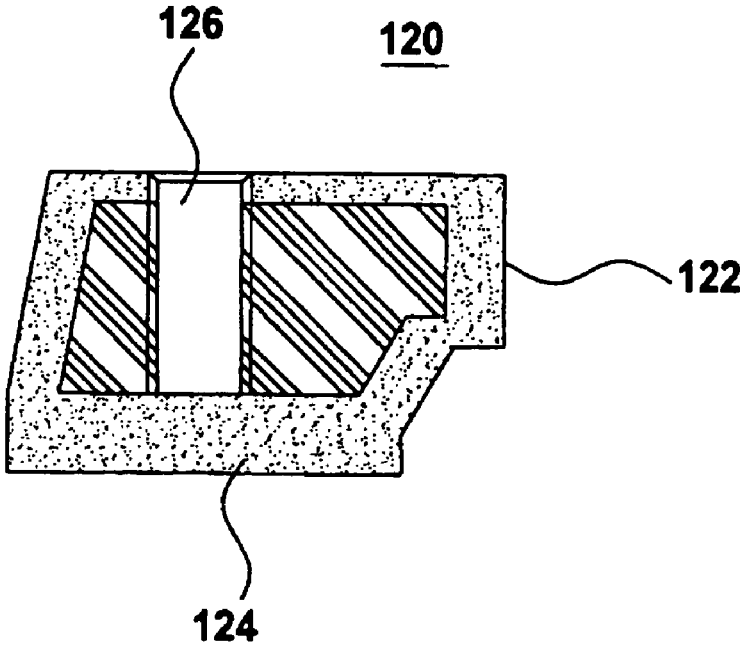
FIG. 2B shows an enlarged sectional view illustrating a part of a carrier of the polishing head, to which the retainer ring shown in FIG. 1 is connected.

FIG. 2A shows an enlarged sectional view illustrating the retainer ring shown in FIG. 1 and FIG. 2B shows an enlarged sectional view illustrating a part of the carrier 110 of the polishing head, to which the retainer ring 120, shown in FIG. 1, is connected.

The retainer ring 120 is connected to the carrier 110 of the polishing head 10. The retainer ring 120 is comprised ofa first member 122 made of resin material, where a room is provided, and a second member 124 made of metal material, which is embedded in the room of the first member 122.

Further, a connecting tap 126 to connect to the carrier 110 is provided at the retainer ring 120, as shown in FIG. 2B. Here, in order to prevent the first member 122, which contacts the polishing pad 20, from being deformed, the connecting tap126 is formed from the side where the retainer ring 120 attaches to the carrier 110 to the predetermined depth into the second member 124.

The first member 122 is made of resin material as like an engineering plastic in consideration of contacting with the polishing pad 20 and the second member 124 is made of metal material such as stainless steel, steel, aluminum, brass, etc, to prevent the retainer ring 120 from being twisted.

Such the retainer ring 120 can be made by an injection molding technique. For an example, after the second member 124 of metal is made, the first resin member 122 is made outside the second member 124 by an injection molding technique such that a room is formed.

For another example, after the first member 122 is provided so that a room is formed therein, the second member 124 is formed by an injection molding.

For still another example, after the first member 122 is provided so that a concave portion is formed therein, the second member 124, which was provided beforehand, is embedded into the concave portion and the top of the concave portion is sealed.

The retainer ring 120 having such the structure can prevent itself from being twisted without bonding and can reduce defects of the semiconductor wafer 30 caused by corrosion of the slurry due to the bonding.

Figure 3:
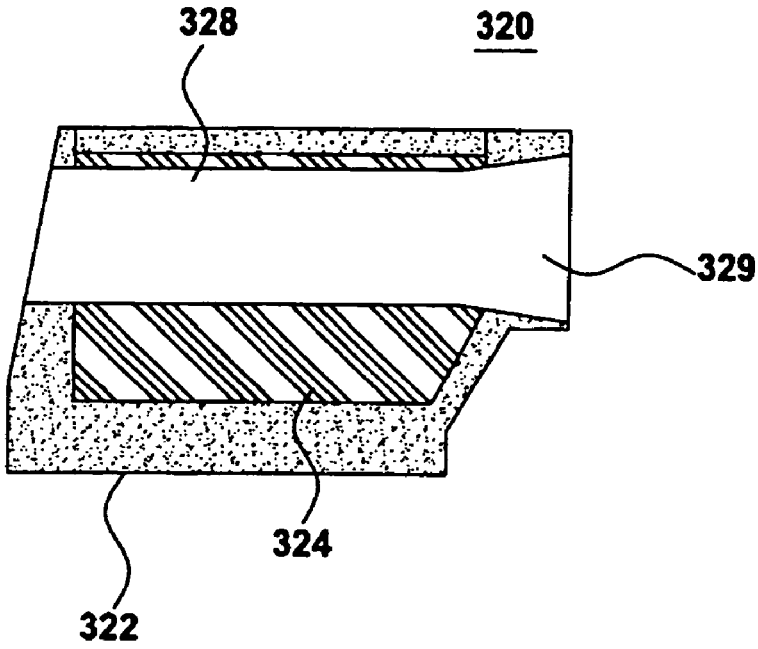
FIG. 3 shows a sectional view illustrating a retainer ring according to the second embodiment of the present invention.

FIG. 3 shows a sectional view illustrating a retainer ring 320 according to the second embodiment of the present invention.

Most elements of the retainer ring 320 are similar to those of the retainer ring 120 according to the first embodiment except a through hole 328 which is formed to penetrate its side and thus, detailed description will be omitted.

The through hole 328 is formed to penetrate sides of the first member 322 and the second member 324. as shown in FIG. 2, and a taper 329 is formed with larger diameter than that of the through hole 328 at the end of the through hole 328 that is, toward outside of the carrier 110.

The through hole 328 serves as a path through which the slurry is flowed into the inner side of the polishing head 10 when polishing and the taper 329 works so that the slurry can be flowed into the through hole 328 smoothly.

Through hole 328 and the taper 329 provides flows of the slurry as described above when polishing and further, provides a path through which a cleaner can be flowed into when cleaning so that the cleaning of the inner side of the polishing head 10 can be done smoothly.

Figure 4:
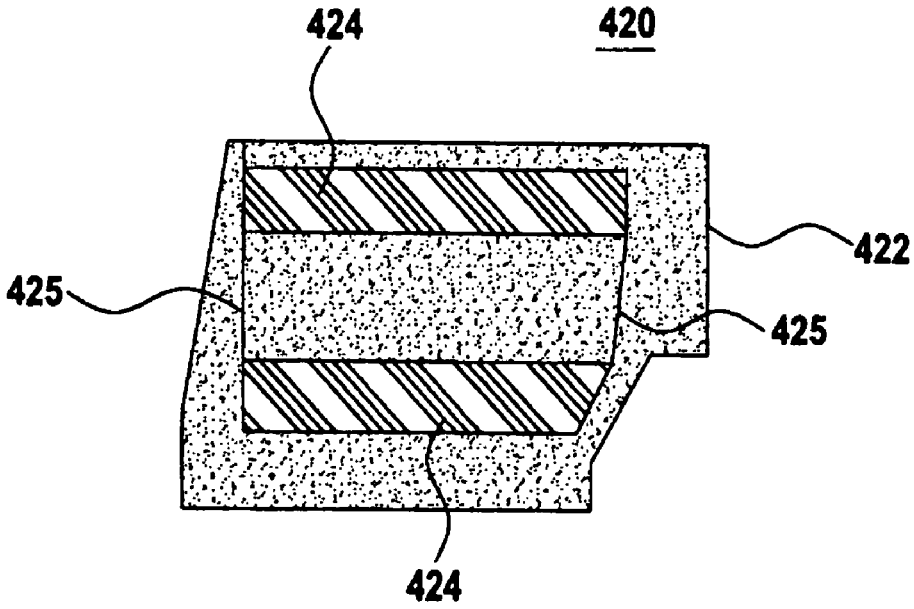
FIG. 4 shows a sectional view illustrating a retainer ring according to the third embodiment of the present invention.

FIG. 4 shows a section view illustrating a retainer ring 420 according to the third embodiment of the present invention.

The retainer ring 420 is connected to the carrier 110 of the polishing head 10. The retainer ring 420 is comprised of a first member 422 where a room is provided inside and two pieces of the second metal member 424.

In order that one piece of the second member 424 is placed above the first member 422 and the other piece of the second member 424 is placed below the first member 422, two pieces of the second member 424 are connected by welding 425 as like a brazing while a constant distance is maintained.

To produce such the retainer ring 420, it is preferable that two pieces of the second member 424 are prepared beforehand and two pieces of the second member 424 are connected by welding while maintaining a constant distance between two pieces of the second member 424 and the first member 422 is injected to the outside of the two pieces of the second member 424, finally.

Because two pieces of the second member 424, which are connected by welding with a constant distance, are embedded into the first member 422, deformation of the retainer ring 420 such as twist can be reduced more effectively.

Figure 5:
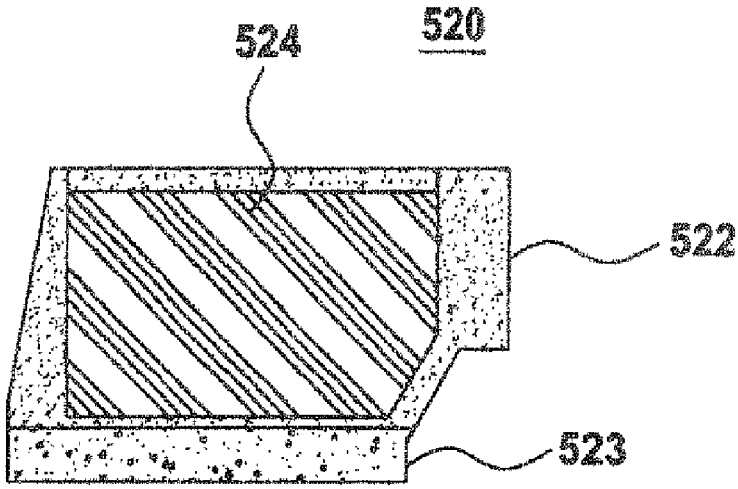
FIG. 5 shows a sectional view illustrating a retainer ring according to the fifth embodiment of the present invention.

FIG. 5 shows a sectional view illustrating a retaining ring 520 according to the fourth embodiment of the present invention.

Most elements of the retainer ring 520 are similar to those of the retainer ring 120 according to the first embodiment except the third member 523 which is formed in its bottom and thus, detailed description will be omitted.

The retainer ring 520 is made of the same material as well as the first member 522, as shown in FIG. 5, and the third member 523 which is purer than the first member 522 is welded to the bottom of the first member 522 with friction heat.

At this time, the first member 522 and the third member 523 are made of resin material such as Polyphenylene sulfide (PPS), Polyimide, Polybenzimidasole (PBI), Polyetheretheketon (PEEK), Polycarbonate, Acetal, Polyetherimid (PEI), Polybutylene terephthalate (PBT) and Polyethylene terephthalate (PET), etc, The retainer ring 520 with such the structure as described above can reduce cost to produce because only the third member 523 is made of relatively high purity material and the others are made of a relatively low purity material.

Figure 6A:
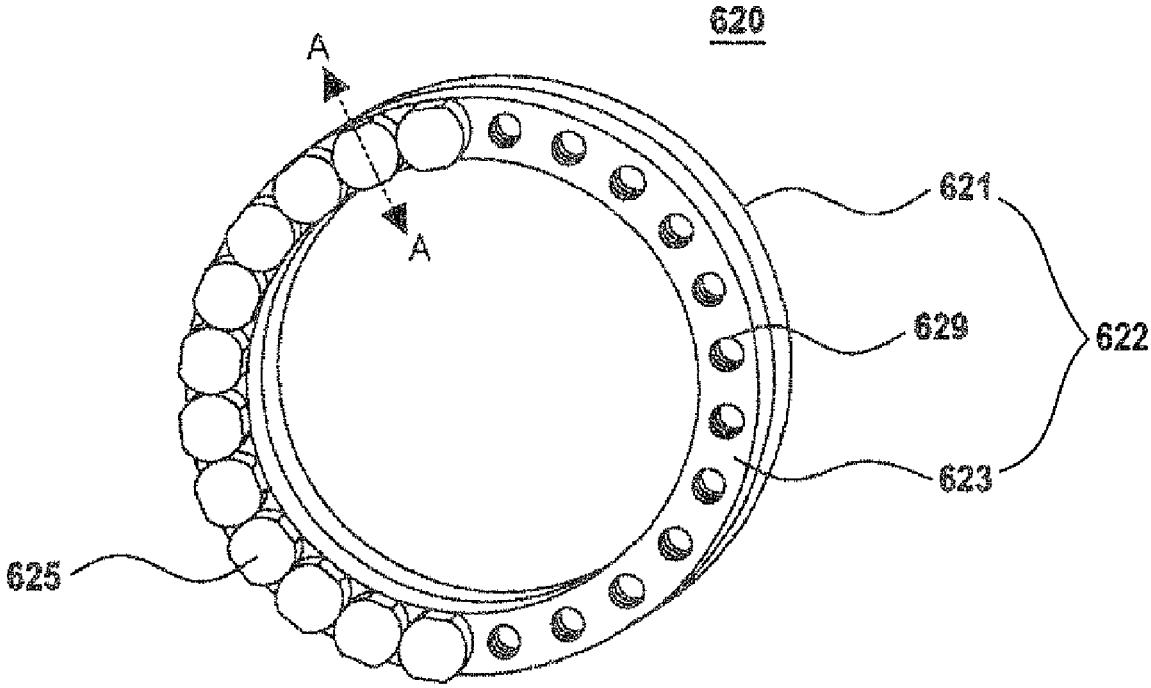
FIG. 6A shows a perspective view illustrating a retainer ring according to the fifth embodiment of the present invention.
Figure 6B:
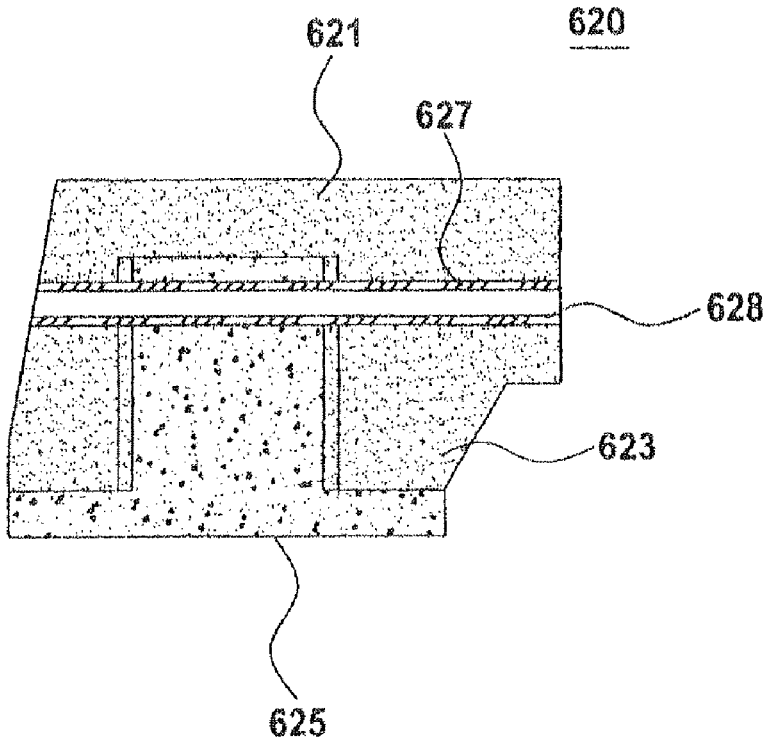
FIG. 6B shows a sectional view along the line A-A' of FIG. 6A.
Figure 7:
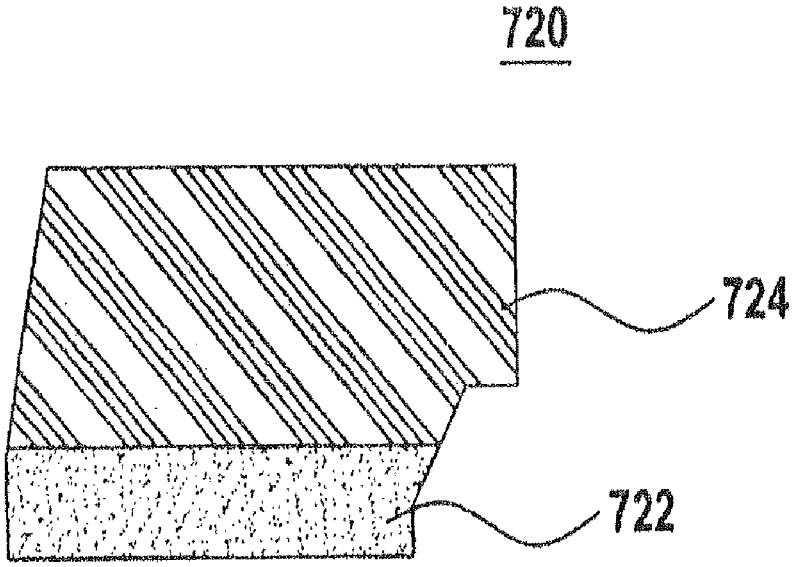
Fig. 7 (Related Art)
FIG. 7 shows a sectional view illustrating a retainer ring of a conventional chemical-mechanical polishing device.

FIG. 6A shows a perspective view illustrating a retainer ring 620 according to the fifth embodiment of the present invention and FIG. 6B shows a sectional view along the line A-A' of FIG. 6A.

The retainer ring 620 is comprised of an upper portion 621, which is installed to the carrier 110 of the polishing head 10, and a lower portion 623, which is connected through a plurality of bolts 625, and a tap 629 is formed at the both of the upper portion 621 and the lower portion 623 to insert the plurality of bolts 625, respectively.

Further, both of the upper portion 621 and the lower portion 623 of the retainer ring 620 are made of the first resin member 622, where a room is formed therein, and the second member 624 is inserted into the room of the first member 622.

The first member 622 is made of resin material such as an engineering plastic, the second member 624 is made of metal material such as a stainless steel, a steel, an aluminum, brass, etc, and the bolt 625 is made of resin material in consideration with contacting to the polishing pad 20.

In order to prevent loosening of the bolt 625, a hole to penetrate one end of the bolt 625 and the corresponding position of the upper portion 621 in a line is formed at the upper portion 621 and the bolt 625, as shown in FIG. 6B, and a spring pin 627 is inserted into the hole.

In order to smooth the flow of the slurry when polishing, a through hole 628 is formed to penetrate the spring pin 627

The retainer ring 620 with such the structure as described above can be attached and/or detached easily to and/or from the upper portion by the bolt 625, prevent the bolt from being loosened, get the slurry flowed smoothly, and thereby, get the polishing process stabilized.

Advantageous Effects

As described above, according to the retainer ring of the chemical mechanical polishing device of the present invention, uniformity within the semiconductor wafer processed by a chemical mechanical polishing device can be increased because the retainer ring is prevented from being twisted by forming the retainer such that the second metal member is formed inside the first resin member.

Further, defects generated when polishing can be prevented because generation of particles due to corrosion of the slurry in accordance of the bonding structure is prevented by melting the second members of same material with friction heat.

Further, the present invention can reduce cost to produce because the proportion of high purity material is reduced by making only the portion to be contacted to the polishing pad with high purity material.

Further, the present invention can reduce a defective proportion of the polishing process by preventing the retainer ring from being relieved, so that the upper portion and lower portion of the retainer ring is connected through a resin bolt and a spring pin to fix the bolt is inserted through a hole to penetrate the bolt.

Further the present invention can extend the life time of the polishing pad and the retainer ring by smoothing the flow of the slurry when polishing, so that a through hole to penetrate a side of the retainer ring is formed.

Further, the present invention can improve a defective proportion of a semiconductor wafer polishing process by above effects and can reduce initial limitation conditions accompanied to mass production to increase an equipment operation rate by providing credibility of the retaining ring.

What is claimed is:

1. A retainer ring installed to a polishing head of a chemical mechanical polishing device to fix a semiconductor wafer, the retainer ring comprising:

a first member of a resin connected to a carrier of the polishing head and a room is formed inside; and a second member of a metal embedded into the room of the first member, wherein a through hole to penetrate sides of the first member and sides of the second member is provided.

2. The retainer ring of claim 1, wherein the second member comprises a material selected from a group consisting of stainless steel, steel, aluminum and brass.

3. The retainer ring of claim 1, wherein a connecting tap from one end of the first member connected to the carrier to the second member is provided.

4. The retainer ring of claim 1, wherein a taper is provided toward outside of the carrier at the through hole.

5. A retainer ring installed to a polishing head of a chemical mechanical polishing device to fix a semiconductor wafer, the retainer ring comprising:

a first member of a resin connected to a carrier of the polishing head and a room is formed inside; and a second member of a metal embedded into the room of the first member, wherein the second member is comprised of two pieces and the two pieces are connected by welding.

6. A retainer ring installed to a polishing head of a chemical mechanical polishing device to fix a semiconductor wafer, the retainer comprising:

a first member including an upper portion and a lower portion with a room arranged therein, the upper portion connected to a carrier of the polishing head and the lower portion connected to the upper portion through a plurality of bolts, wherein the upper portion and the lower portion are made of a resin; and a second member embedded into the room of the upper portion or the lower portion, the second member being metal, wherein the upper portion and the lower portion are separable.

7. The retainer ring of claim 6, wherein the second member is made of material such as stainless steel, steel, aluminum and brass.

8. The retainer ring of claim 6, wherein the bolts are comprised of resin material.

9. The retainer ring of claim 6, wherein a hole to penetrate one end of the bolt and the corresponding position of the upper portion in a line is provided and a spring pin is inserted in the hole.

10. The retainer ring of claim 9, wherein a through hole to penetrate in the spring pin is provided.

* * * * *